United States Patent [19]
Moser et al.
[11] 4,370,956
[45] Feb. 1, 1983

[54] ARRANGEMENT FOR HEATING THE OIL CONTAINED WITHIN AN OIL RESERVOIR OF A MACHINE OR OF AN INTERNAL COMBUSTION ENGINE OF A MOTOR VEHICLE

[75] Inventors: Gottfried Moser, Gladbach; Hansjurgen Gross, Niederkassel, both of Fed. Rep. of Germany

[73] Assignee: Klockner-Humboldt-Deutz AG, Cologne, Fed. Rep. of Germany

[21] Appl. No.: 165,083

[22] Filed: Jul. 1, 1980

[30] Foreign Application Priority Data

Oct. 6, 1979 [DE] Fed. Rep. of Germany ..... 2940643

[51] Int. Cl.[3] ..... F01M 1/00

[52] U.S. Cl. ..... 123/196 AB; 126/247; 184/104 A; 237/12.3 R; 123/142.5 R

[58] Field of Search ..... 123/198 C, 196 AB, 142.5 R, 123/195 A, 196 S; 126/247; 184/104 A; 237/12.3 A, 12.3 B, 12.3 C, 1 R

*Primary Examiner*—Charles J. Myhre
*Assistant Examiner*—E. Rollins Cross
*Attorney, Agent, or Firm*—Watson, Cole, Grindle & Watson

[57] ABSTRACT

An arrangement for heating the oil contained within an oil reservoir of a machine or of an internal combustion engine of a motor vehicle includes a hydraulic pump for suctioning the oil from the reservoir and returning it thereto through an oil conduit into which the pump is coupled. At least one operating element in the form of a throttle is coupled into the conduit at the pressure side of the pump for constricting the flow of oil through the conduit, and the pump is coupled with a source of power to be thereby driven. Thus, the temperature of the oil within the reservoir may be elevated by operation of the pump together with the operating element for improving upon the startability of the machine or engine and for sustaining early operation after the start of the machine or engine.

8 Claims, 5 Drawing Figures

ARRANGEMENT FOR HEATING THE OIL CONTAINED WITHIN AN OIL RESERVOIR OF A MACHINE OR OF AN INTERNAL COMBUSTION ENGINE OF A MOTOR VEHICLE

RELATED APPLICATIONS

This application relates to U.S. Ser. No. 123,169, filed Feb. 20, 1980, and to U.S. Ser. No. 123,944, filed Feb. 25, 1980, both commonly owned herewith.

BACKGROUND OF THE INVENTION

This invention relates generally to an arrangement for heating up the oil contained within an oil reservoir associated with a machine or with an internal combustion engine of, for example, a motor vehicle.

Electric heaters, for the heating of the oil contained within an oil reservoir of a machine or of an internal combustion engine, or for the heating of the coolant supply of the machine or engine, have been provided for improving upon the startability of the machine or engine and for sustaining the early operation after the start of the engine or machine. However, such electrical heaters absorb a high degree of power when energized and are otherwise housed in the oil reservoir or in the coolant supply of the internal combustion engine where they remain permanently. Moreover, such electric heaters are typically usable only for stationary machine or engine installations, or for the initial heating of the oil or coolant of internal combustion engines of motor vehicles while immobilized, since the high power for energizing the heaters can only be fed from an outside source so that any further heating of the oil or coolant even during the first operating phase of the machine or engine is not possible.

SUMMARY OF THE INVENTION

It is an object of the present invention to provide an arrangement for heating, in a simple manner, the oil contained within an oil reservoir of a machine or of an internal combustion engine of a motor vehicle such that the machine or engine can be heated up during a standstill condition and may be further heated up during the first operating phase thereof, the arrangement either remaining coupled to the engine or machine or forming a separate unit to be coupled thereto for externally heating up the oil. More specifically, the arrangement includes a hydraulic pump for suctioning the oil from the reservoir and returning it thereto through an oil conduit into which the pump is coupled. At least one operating element, in the form of a throttle, is coupled into the conduit at the pressure side of the pump for constricting the flow of oil through the conduit, and the pump is coupled with the engine or with an outside power source to be thereby driven. Thus, the temperature of the oil within the reservoir may be elevated by operation of the pump together with the operating element for improving upon the startability of the engine or machine and for sustaining the early operation after the start of the engine or machine. The oil contained within the reservoir is therefore heated up directly while the pump feeds the oil to the operating element at a high pressure, approximately 150 bar. Such operating element may be in the form of either a fixed or an adjustable throttle. And, the throttle may be thermostatically adjustable so as to produce a constant oil temperature by adjustably constricting the passage of oil therethrough. Or, after achieving a desired temperature of the oil, the throttle may be opened a sufficient amount so that no appreciable energy is further absorbed by the hydraulic pump.

In accordance with one embodiment, the hydraulic pump may be coupled with an auxiliary motor which is powered by an outside power source such as a battery. The pump, operating element, motor and outside power source may comprise a unitary assembly including a portion of the oil conduit, quick release couplers being provided for quickly connecting and disconnecting the unitary assembly with the remainder of the conduit leading from and to the oil reservoir.

In another embodiment according to the invention, the hydraulic pump may be releasably coupled with the engine or machine or with an auxiliary outside power source through a driving motor. Quick release of couplers are provided for selectively coupling the pump with the engine and with the auxiliary power source so that the pump may be selectively driven by the engine or by the outside power source through the motor. The hydraulic pump may therefore be driven prior to the start of the internal combustion engine by either external power or by internal power for heating the oil. The heating may take place by disconnecting the coupling to the auxiliary power source and by coupling the pump to the internal combustion engine after the start of the machine, so that a quick heating up of the machine is possible. Such is of particular significance for military use.

The present arrangement may also include a heat exchanger coupled into the oil conduit at the discharge side of the operating element, so that operation of the pump together with the operating element also serves to raise the temperature of the oil before reaching the heat exchanger to thereby increase the heating efficiency thereof which functions as an oil/air heat exchanger for heating up either the engine room associated with the machine or the control cabin associated with the internal combustion engine. Also, for liquid-cooled internal combustion engines, the heat exchanger may be provided for heating up the cooling agent simultaneously with the start up of the engine and the heating up of the oil. The hydraulic pump may be permanently coupled with the internal combustion engine or machine to be thereby driven, in which case a by-pass line may be provided for by-passing the heat exchanger and/or the operating element by operation of an adjustable valve provided in the by-pass line to effect a by-pass during the operation of, for example, the engine or machine in hot or warm summer months.

According to another embodiment, the present arrangement may include the provision of more than one operating element connected in parallel into the oil conduit at the pressure side of the hydraulic pump, with switching being provided for controlling the flow of oil selectively through one or more elements or through each of them depending on the size of the hydraulic pump and the rpm range of it and possibly for the coordination of the operating elements. Such an arrangement is therefore more adaptable to accommodate various sizes of machines and internal combustion engines as compared to the use of a single operating element. Each of the plurality of operating elements may be of simple construction so that the volume of flow therethrough and thus the range of adjustment of each element may be kept lower. This may result in the minimizing of the noise level and may increase the safety of operation such that in the event of failure of, for example, the thermostatic control of an operating element, another operating element may create an operating balance so that the heating up of the oil does not take place continuously. Pressure-dependent control switches may be associated with the several operating elements for switching them on and off, depending on the conveyed volume. Such switches may comprise separate spring-loaded valves or spring-loaded controls of the operating elements themselves so that with an increase or a decrease of the pressure in the oil conduit, the operating elements are switched on and off.

DETAILED DESCRIPTION OF THE INVENTION

Figure 1:
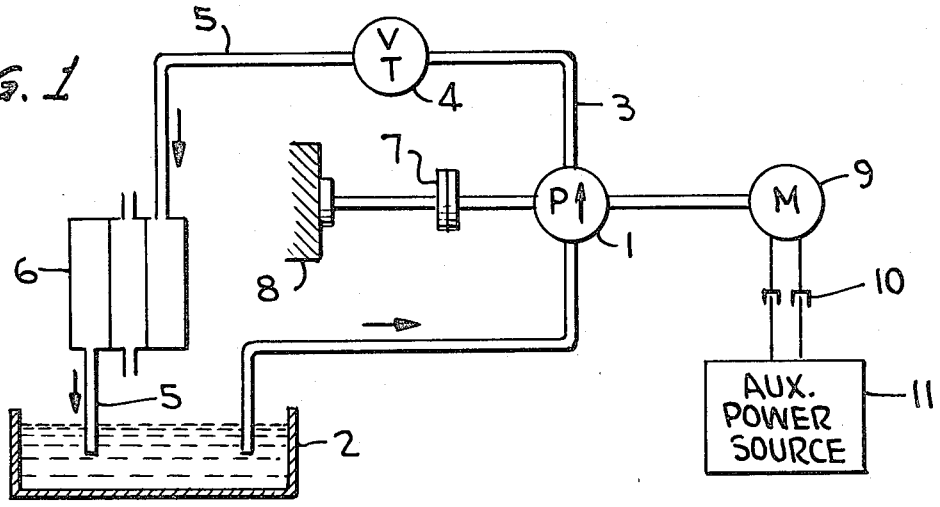
FIG. 1 is a diagrammatic illustration of the arrangement according to one embodiment of the invention.

In FIGS. 1 to 4, a hydraulic pump is generally designated 1 and operates to suction oil from a lubricating oil reservoir 2 or from a similar oil supply of a machine or of an internal combustion engine. The oil is pumped directly from the oil reservoir and is conveyed by the pump through an oil conduit 3 to an operating element 4 which may be in the form of a throttle, or the like, for constricting the flow of oil through the conduit to thereby increase the temperature of the pumped oil together with the operation of the pump. A discharge line 5 leads away from the operating element and back to the oil reservoir. In the FIGS. 1, 2 and 4 embodiments, a heat exchanger 6 is coupled into discharge line 5 and may be utilized to heat, for example, the coolant of the internal combustion engine, the air of the machine room associated with the machine to which the present arrangement is applied or the control cabin associated with the driver's cabin of the motor vehicle with which the present arrangement is operable.

As shown in FIG. 1, the hydraulic pump may be releasably coupled as at 7 with an internal combustion engine generally designated 8. The pump may be optionally coupled with an electric motor 9 which is powered by an auxiliary power source 11 via rapid release couplers 10. Thus, the hydraulic pump may be driven prior to the start of the internal combustion engine by either external power or by internal power so that the pressure produced by the hydraulic pump is reduced in the operating element so that the heat produced in the pump and in the operating element effects an increase in temperature of the oil which is discharged directly back into the oil reservoir. And, before being discharged back into the oil reservoir, the oil passing through the heat exchanger may function to heat the coolant system of the engine, the control cabin associated with the machine 8, or the driver's cabin associated with engine 8 of a motor vehicle (not shown). The heating may take place by turning off motor 9 and by coupling, in any normal manner, generally shown at 7, the hydraulic pump to engine 8 after the start of the engine, so as to facilitate a quick heating up thereof.

Figure 2:
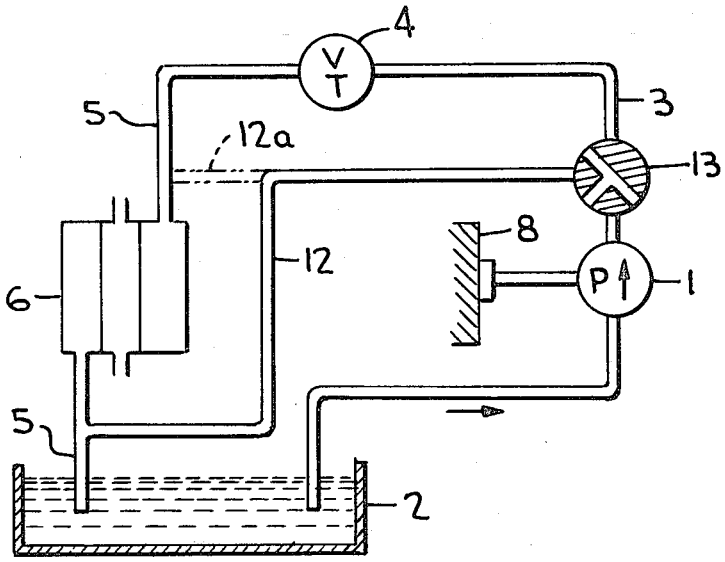
FIG. 2 is a diagrammatic illustration of a modification of the FIG. 1 arrangement wherein the hydraulic pump is driven continuously by the internal combustion engine, and a by-pass line is provided.

In the FIG. 2 embodiment, the hydraulic pump is shown permanently coupled with internal combustion engine or machine 8, and a by-pass line 12 is arranged in parallel to operating element 4 and to heat exchanger 6, the flow through this line being controlled by an adjustable two-way valve 13 similar to that shown in the aforementioned application Ser. No. 123,169. Line 12 may alternatively by-pass only operating element 4 by the provision of a segment 12*a* thereof which is disposed as shown in dotted outline. Thus, the heating arrangement may be switched off by diverting the flow of oil through line 12 upon operation of valve 13. Alternatively, only the operating element may be by-passed (through lines 12 and 12*a*) for effectively switching off the heat exchanger.

Figure 3:
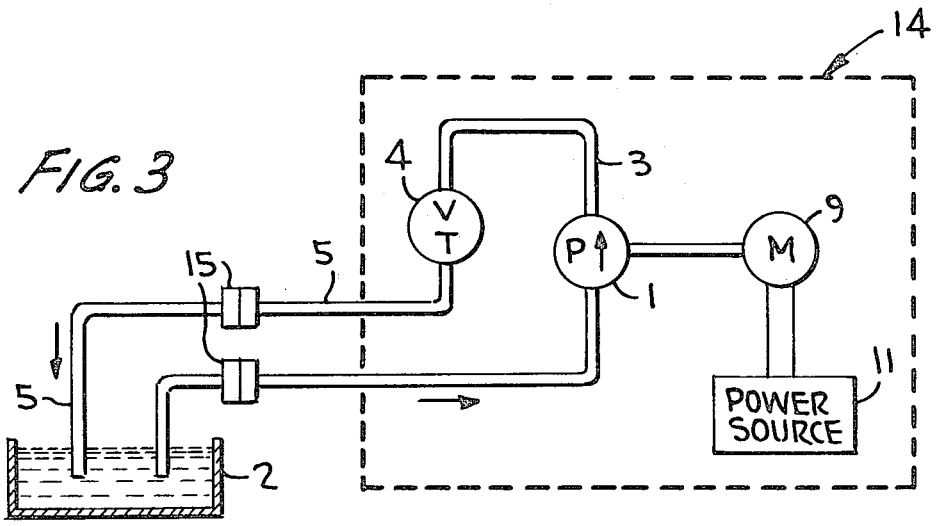
FIG. 3 is a diagrammatic illustration of another embodiment according to the invention wherein the hydraulic pump, its external source of power and the operating element are combined into a unitary assembly capable of being connected and disconnected in place.

In the FIG. 3 embodiment, the hydraulic pump is permanently coupled with motor 9 which is powered by an auxiliary power source 11, and is combined together with operating element 4 into a unitary assembly generally designated 14 which may be formed as a movable heating unit. Rapid release couplings 15 are provided in the oil conduit at the suction side of the pump and at the discharge side (in line 5) of the operating element so that assembly 14 may be quickly connected and disconnected with those remaining portions of the oil conduit leading from and to the oil reservoir. Quick release couplings can be easily retrofitted to existing machines and engines for adapting them for use with the present arrangement.

Figure 4:
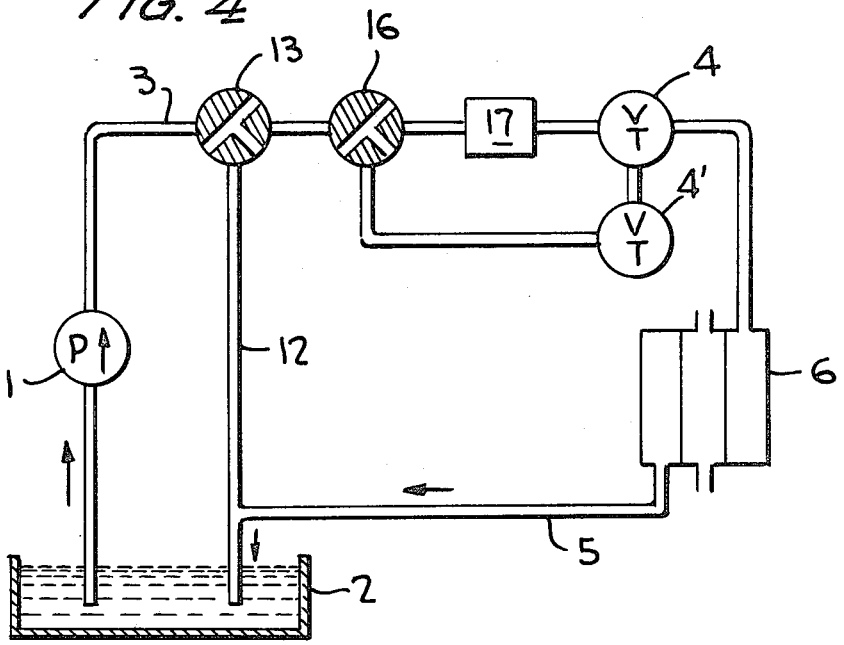
FIG. 4 is a diagrammatic illustration of still another embodiment wherein two operating elements are connected in parallel.
Figure 4A:
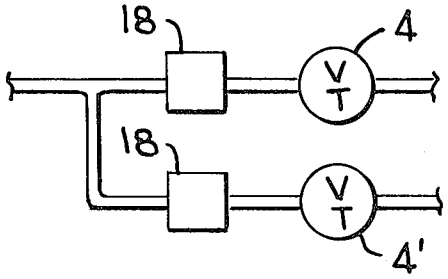
FIG. 4A is a view similar to FIG. 4 showing pressure-dependent control switches associated with each of the operating elements.

Any of the FIGS. 1 to 3 embodiments may include another feature of the invention wherein two operating elements 4, 4' are connected in parallel into the oil conduit, a two-way valve 16 being provided for valving the oil into one or the other or both of these operating elements to accommodate various sizes of machines and internal combustion engines. Optionally, an excess pressure valve, such as 17, may be provided in the feed line to operating element 4 so that upon exceeding a certain pressure, the flow through only element 4' takes place. The operating elements may otherwise have pressure-dependent control switches 18 (see FIG. 4A) adjusted to different pressures so that below a certain pressure, only one operating element will function. Excess pressure valves 17 may be in the form of a simple throttle-shutter, and switches 18 may be in the form of spring-loaded valves for switching the operating elements on and off in dependence upon an increase and decrease of the pressure in the feed lines associated therewith. And, although only two operating elements 4, 4' are shown in parallel, it should be understood that three, or four, or more operating elements may be provided in parallel for functioning in a like manner as described with reference to FIG. 4A. Two-way valve 13, or the like, functions together with by-pass line 12 in the same manner as described with reference to FIG. 2.

Obviously, many other modifications and variations of the present invention are made possible in the light of the above teachings. It is therefore to be understood that within the scope of the appended claims, the invention may be practiced otherwise than as specifically described.

What is claimed is:

1. An arrangement for heating the lubricating oil contained within an oil reservoir of a machine or of an internal combustion engine of a motor vehicle, the machine or engine having a lubricating oil distribution system including means for circulating the lubricating oil at a predetermined pressure level from the oil reservoir into pressurized oil lines of the machine or engine, a heating system including a hydraulic pump for suctioning the oil from said reservoir and returning it thereto through an oil conduit into which said pump is coupled, at least one operating element coupled into said conduit at the pressure side of said pump for constricting the flow of oil through said conduit, said pump being coupled with a source of power to be thereby driven, said pump having a capacity to produce a pressure of about one order of magnitude higher than said predetermined pressure level effected by said circulating means, said source of power comprising one of said engine and a driving motor coupled with an auxiliary power source, a first releasable coupler located between said engine and said pump and a second releasable coupler located between said pump and said auxiliary power source for selectively coupling said pump with said engine or with said auxiliary power source for regulating said heating system as said pump is selectively driven by said engine or by said motor or by neither said engine nor said motor, whereby the temperature of the oil within said reservoir may be controlled before and after operation of the machine or engine.

2. The arrangement according to claim 1, wherein said hydraulic pump is connected with said driving motor and forms a unitary assembly together with said operating element including a portion of said oil conduit, said portion being detachably coupled with the remainder of said conduit by quick release couplers provided in said conduit, said quick release couplers being located at the suction side of said pump and at the discharge side of said operating element, whereby said assembly may be quickly connected and disconnected with said remainder of said conduit leading from and to said oil reservoir.

3. The arrangement according to claim 1, wherein the machine is associated with a control cabin and the engine is associated with the driver's cabin of the motor vehicle, a heat exchanger being coupled into said conduit which is located at the outlet side of said operating element, whereby the operation of said pump together with said operating element also serves to raise the temperature of the oil before reaching said heat exchanger to thereby increase the heating efficiency of said exchanger for either of said cabins.

4. The arrangement according to claim 3, wherein a by-pass line for the oil is provided in said conduit for by-passing at least said operating element, an adjustable control valve provided in said line for selectively valving the oil through said operating element and through said by-pass line depending upon the extent the temperature of the oil is to be elevated.

5. The arrangement according to claim 4, wherein said by-pass line is provided for also by-passing said heat exchanger.

6. The arrangement according to claim 1, 2, 3, 4 or 5, wherein at least two operating elements are coupled into said conduit at the pressure side of said pump for selectively constricting the flow of oil through said conduit, a valve provided in said conduit for selectively controlling the flow of oil through one, the other or both of said operating elements depending on the desired temperature of the oil to be reached.

7. The arrangement according to claim 1, 2, 3, 4 or 5, wherein at least two operating elements are coupled into said conduit at the pressure side of said pump for constricting the flow of oil through said conduit, control devices in said conduit being associated with said elements for switching said elements on and off depending on pressure and/or volume of oil conveyed through said conduit.

8. The arrangement according to claim 7, wherein said control devices comprise spring-loaded valves.

* * * * *